United States Patent [19]

Johannson

[11] Patent Number: 4,498,838

[45] Date of Patent: Feb. 12, 1985

[54] RETENTION DEVICE FOR A LOAD ENGAGING MEMBER

[75] Inventor: Richard J. Johannson, Dallas, Oreg.

[73] Assignee: Towmotor Corporation, Mentor, Ohio

[21] Appl. No.: 481,601

[22] Filed: Apr. 4, 1983

[51] Int. Cl.[3] ..... B66F 9/14

[52] U.S. Cl. ..... 414/664; 414/667

[58] Field of Search ..... 414/628, 629, 639, 643, 414/645, 647, 652, 662–664, 667, 668, 671, 785; 187/9 R

[56] References Cited

U.S. PATENT DOCUMENTS 3,814,272 6/1974 Spratt ..... 187/9 R X 3,825,139 7/1974 Geis .

*Primary Examiner*—Robert G. Sheridan

*Attorney, Agent, or Firm*—Alan J. Hickman

[57] ABSTRACT

This invention relates to a retention device (30) for releasably maintaining a load engaging member (24) at a transport position (28) which eliminates the problems of supporting and simultaneously locking the load engaging member (24) at the transport position (28), failure of the lock device due to the weight of the load engaging member acting thereon, and alignment of the load engaging member (24) with the locking device. The retention device (30) has a stop (66) connected to the load engaging member (24) and a flange (40) engageable by the stop (66) at the transport portion of the load engaging member (24), to support the load engaging member (24) and the weight thereof at the transport position (28). The retention device (30) also has an engaging device (74) which engages the stop (66) and prevents pivotal movement of the load engaging member (24) from the transport position (28) to a load carrying position (26). Thus the problems of failure, alignment and support of the load engaging member (24) are eliminated. The retention device (30) is particularly suited for retaining the fork (24) of a carriage assembly (20) of a lift mast (12) at the transport position (28).

16 Claims, 3 Drawing Figures

RETENTION DEVICE FOR A LOAD ENGAGING MEMBER

TECHNICAL FIELD

This invention relates to a retention device for a load engaging member and more particularly to a retention device for maintaining a fork of a lift mast carriage assembly at a transport position.

BACKGROUND ART

Load engaging members, such as forks, clamps, rods and the like are normally pivotally mounted on the carriage of a lift mast assembly. Typically, the load engaging member has a connecting end portion slidably and pivotally mounted on a horizontal shaft of the carriage. In some applications, for example rough terrain operation it is desirable to be able to pivot the fork about the shaft from a load engaging position, at which the fork extends forwardly from the carriage and the vehicle upon which the mast is mounted, to a transport position, at which the fork extends in a direction toward the vehicle. With the fork in the transport position the overall length of the vehicle is reduced. This permits the vehicle to be transported on a shorter truck bed, towed with a reduced turning radius and able to descend steep inclined ramps.

One problem encountered during transport of the lift trunk is inadvertent movement of the fork from the transport position to the load engaging position caused by bouncing of the vehicle, descending steep ramps, etc.

U.S. Pat. No. 3,825,139 dated July 23, 1974 to Warren P. Geis deals with this problem by providing a locking device which engages the fork and positively holds the fork in the transport position. This solution, however, has several deficiencies which the subject invention is directed to overcome.

Since the locking device positively supports the weight of the fork, the shear loads placed thereon during transport caused by fork bouncing will alternately cause failure of the locking device.

Also, the fork must be located at a specificed precise longitudinal position along the shaft in order to be engaged by the locking device. Due to the weight of the fork, this alignment is difficult to achieve and a substantial amount of time is wasted on the part of the operator.

Since the weight of the fork in the transport position tends to return the fork to the load engaging position the operator, during the locking operation, must support the weight of the fork at the time of engaging the lock. This is obviously a difficult task and requires a substantial amount of effort.

The present invention is directed to overcoming one or more of the problem as set forth above.

DISCLOSURE OF THE INVENTION

In one aspect of the present invention, a retention device for a load engaging member pivotally mounted on a support member and pivotally movable between a load carrying position and a transport position is provided. A stop, connected to the load engaging member, engages a flange at the transport position of the load engaging member and supports the load engaging member at the transport position. An abutment member is engageable with the stop at a range of locations of the fork along the support member and prevents pivotal movement of the load engaging member from the transport position to the load carrying position.

Therefore, the retention device alleviates the problems previously discussed by utilizing the stop to support the overcenter load of the fork at the transport position, provides a range of locations along the supporting shaft at which the fork can be placed in the transport position, and provides an engaging device which prevents the fork from pivotally moving from the transport position to the load carrying position. Since the fork is at an overcenter location in the stored position, the operator does not have to support the weight of the fork while placing the engaging device in position to engage the stop.

BEST MODE FOR CARRYING OUT THE INVENTION

Figure 1:
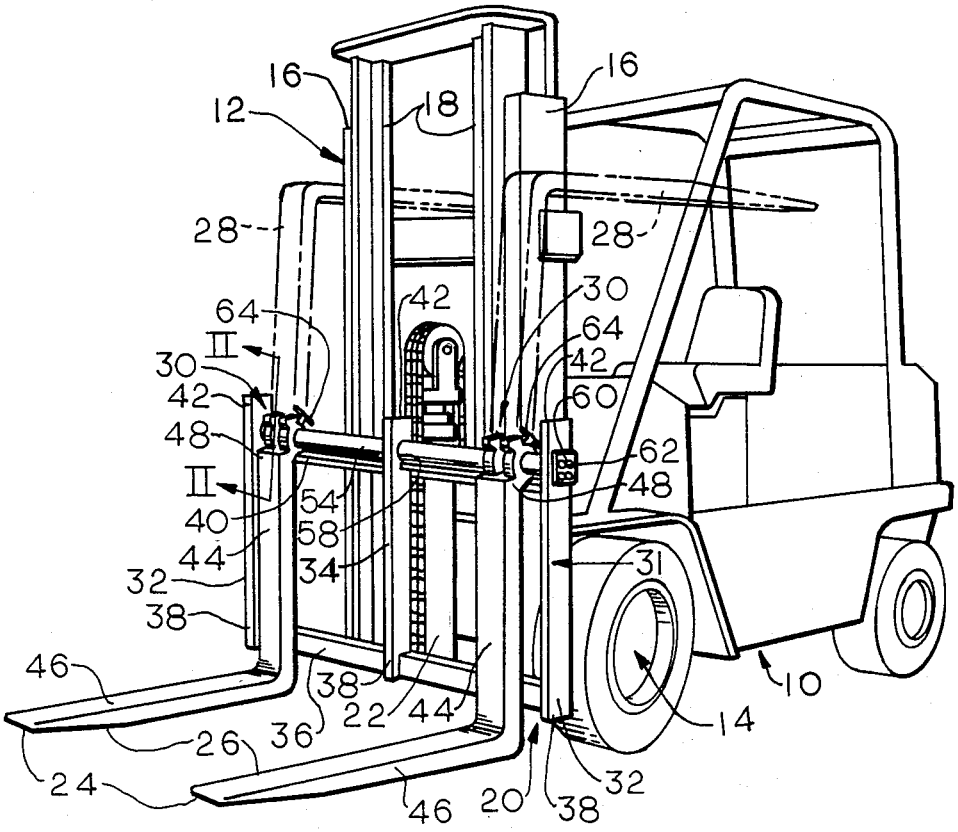
FIG. 1 is a diagrammatic isometric representation of an embodiment of the present invention, showing a lift truck having a mast assembly mounted thereon and a pair of forks in solid lines in the load carrying position and in phantom lines in the transport position.
Figure 2:
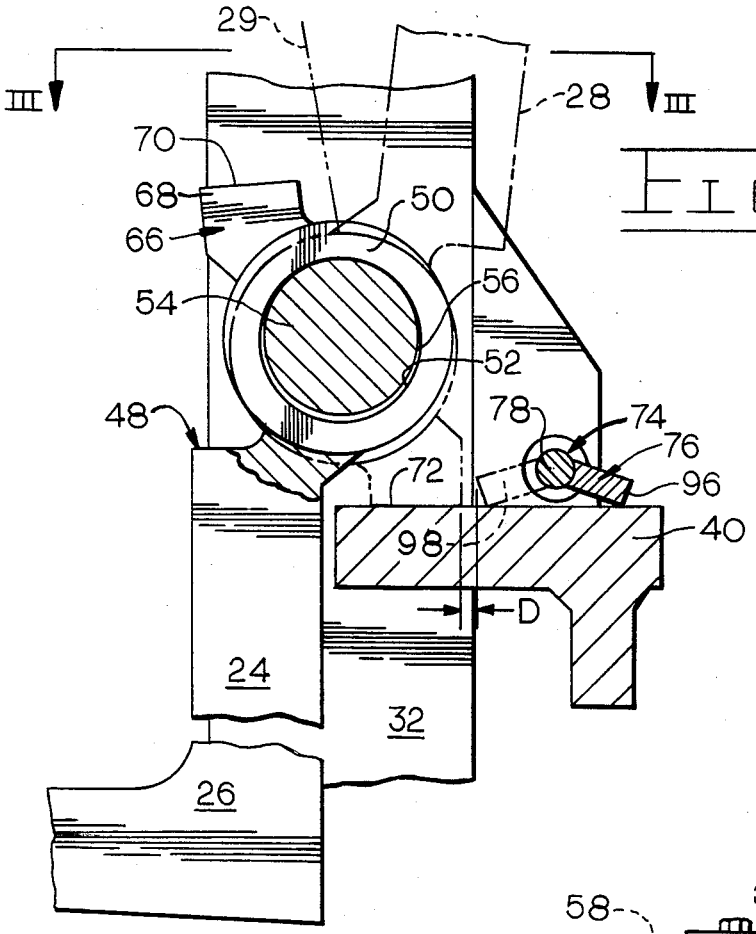
FIG. 2 is a diagrammatic sectional view taken along lines II—II of FIG. 1 showing the retention device in solid lines in the load carrying position and in phantom lines in the transport position.
Figure 3:
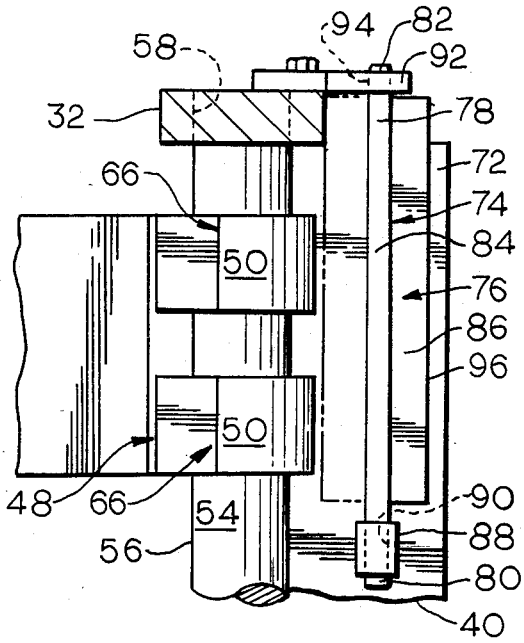
FIG. 3 is a diagrammatic top elevational view taken along lines III—III of FIG. 2, showing the retention device in even greater detail.

Referring to the drawings, and particularly FIG. 1, a lift truck 10 has a lift mast 12 mounted on the front end 14 thereof. The lift mast 12 has a first pair of spaced apart uprights 16 and a second pair of spaced apart uprights 18 mounted on and between said first pair of uprights 16 and elevationally movable relative thereto. A carriage assembly 20 is mounted on the second pair of uprights 18 and elevationally movable relative thereto. A lift jack 22 is provided for powering the carriage assembly 20 and second pair of uprights 18 for elevational movement in a conventional manner.

The carriage assembly 20 has a pair of load engaging forks 24 pivotally mounted thereon. The forks 24 are each pivotally movable between a load carrying position 26, as shown in solid lines, and a transport position 28, as shown in phantom lines.

A retention device 30 is provided for releasably retaining the forks 24 at the transport position and preventing inadvertent pivotal movement of the forks from the transport position 28 to the load carrying position 26.

The carriage assembly 20 has a frame 31 having a pair of spaced apart elongate vertical side members 32, and a vertical center member 34 located between the side members 32. A lower horizontal beam member 36 is connected transversely to a bottom end portion 38 of the side and center members 32 and 34 in a rigid manner such as by welding. In a similar manner, an upper horizontal elongate flange 40, preferably having an angle beam shape, is connected transversely to the pair of side members 32 and center member 34 at an upper end portion 42 thereof in any suitable manner, such as by welding. The carriage assembly 20 is mounted on the second pair of uprights in a conventional manner via a pair of roller brackets connected to each of the upper flange 40 and lower beam 36 and a plurality of rollers, all not shown.

The pair of forks 24 each have a shank portion 44 and a tine portion 46 connected to the shank portion 44 at one end thereof. The tine portion 44 extends from the shank portion and defines an "L" shape. A connecting end portion 48 located at the other end of the shank is provided for connecting each fork to the carriage assembly 20. Specifically, the connecting end portion 48 has a pair of cylindrical sleeves 50 each having a slightly elongate or oversized aperture 52 disposed therethrough. One pair of sleeves are mounted on the other end of each fork at a spaced apart distance from one another and with the apertures 52 aligned. Preferably, the sleeves are welded to their respective forks.

A support member 54 having a cylindrical outer surface 56 is connected to each of the pair of side members 32. The support member 54 is slidably disposed in aligned apertures 58 in the side and center members 32 and 34 at the upper end portion 42 thereof and removably held in place by a plate 60 connected to at least one end of the support member 54 and fastened to one of the side members 32 by a plurality of bolts 62. The support member 54 is preferably located above the flange 40, slightly transversely offset relative to the flange 40 and parallel to the flange 40. The significance of this will be evident during subsequent discussion.

The support member 54 is disposed in the apertures 52 of each of the sleeves 50 and serves to pivotally mount each fork 24 on the carriage 20. The fork tine 46 when mounted on the carriage extends forwardly from the carriage 20 and is normal to the support member 54.

A clamp 64 is provided in the space between each pair of sleeves 50 associated with each fork 24. The clamp 64 is disposed about the support member and releasably engageable therewith to selectively permit or prevent movement of the fork 24 along the support member 54.

A stop 66 is connected to the connecting end portion 28 of each fork 24 and rotatable with the forks. The stops 66 preferably include a projection 68 connected to extend radially from each sleeve 50. The projections are each positioned at a same preselected circumferential location about the sleeve and relative to its respective fork so as to engage the upper flange when the respective forks are at a preselected overcenter position (transport position) and prevent the fork from further pivotal movement past the preselected overcenter position in a direction away from the load carrying position 26. Specifically, the projections each have a flat load supporting surface portion 70 which is engageable with a flat contact surface 72 of flange 40, which is parallel to the support member 54, at the transport position 28 of said forks 24.

The forks 24 are each individually pivotally movable about the support member 54 from the load carrying position 26 past a neutral position 29 and to the transport position 28. At the neutral position 29 of the forks the forces, due to gravity, acting on the forks are at equilibrium and thus the forks are balanced. Once the fork passes the neutral position, the fork will be urged, under its own weight, in a direction toward one of the load carrying or transport positions, depending on which side of the neutral position the fork is on. Thus the stop 66 and the upper flange 40 supports the fork at the transport position of the forks 24.

Since the forks 24 are each slidable along the support member 54 between one of the side members 32 and the center member 34 and the flange 40 extends between the side members, the forks are each supportable at the transport position at any location of the forks along the support member 54.

An engaging device 74 is provided to selectively prevent the fork(s) 20 from pivotally moving between the transport 28 and load carrying 36 positions. The engaging device 74 includes an abutment member 76 connected to the carriage assembly 20 adjacent the flange 40.

The abutment member 76 has a shaft 78 having first 80 and second 82 cylindrical end portions and a middle portion 84. A rectangular shaped projection 86 is connected to the middle portion 84, such as by welding, and extends radially therefrom and relative to the first and second end portions 80 and 82. A first support 88 having a bore 90 therein for receiving the first end portion 80 of the shaft, rotatably connects the first end portion 80 to the flange 40. Similarly, a second support 92, having a bore 94 therein for receiving the second end portion 82 of the shaft 78, rotatably connects the second end portion 82 to one of the side members 32. It should be noted that the first and second supports 88 and 92 could be identical and mounted at a plurality of alternative locations on the carriage 20 without departing from the spirit of the invention. However, it is important that the engaging device 74 is of a length sufficient to engage the stop 66 at a preselected range of locations of the fork 24 along the support member 54. It should be observed that two engaging devices 74 are provided, one for each fork 24, for independently locking each fork at the transport position 28. However, a single engaging device 74 substantially equal in length to the flange 40 could be provided.

The abutment member 76 is rotatable between a first position 96, at which the stop 66 is free from engagement with the projection 86 and the respective fork is free to pivot between the transport 28 and load carrying positions, and a second position 98, at which the stop 66 is contactably engageable with the projection 86 and the fork is restrained from movement from the transport position to the load carrying position. Preferably, the abutment member 76 is positioned a predetermined distance "D" spaced from the stop 66 at the transport position 28 of the fork so that the load of the fork is not transferred to the abutment member 76 and the fork is free to pivot slightly from the transport position 28 toward the load carrying position. The distance "D", however, cannot be large enough in magnitude to permit the fork to pass the neutral (overcenter) position of the fork.

INDUSTRIAL APPLICABILITY

In operation and with reference to the drawings, the fork 24 are each pivoted by the vehicle operator about the support member 54 from the load carrying position 26 to the transport position 28 in order to permit transportation from one job site to another. Since the forks are supported under their own weight by their respective stops 66 and the flange 40 at the transport position 28 (an overcenter position), the operator is free to release hold of the forks and proceed with the locking operation. To retain the forks at the transport position 28 and from inadvertent and undesireable movement to the load carrying position, the operator simply and easily rotates each of the abutment members 76 from the first position 96 to the second position 98. Since the stops 66 move with pivotal movement of its associated fork 24 and the respective abutment member 76 lies within a path of pivotal movement of the stop 66 when at the second position 98, the stops 66 engage the abutment member after the preselected amount of pivotal fork 24 movement taken place and prevent further pivotal movement of the fork toward the load carrying position 26. Because the stops 66 engage the abutment member prior to the forks 24 passing the neutral position 29, the weight of the fork will urge the fork back to the transport position 28. Therefore, the forks only apply a force to the adjacent abutment member 76 intermittently which reduces the potential of structural failure.

Since the abutment member extends along the support member 54 of the carriage 20 a preselected distance, which is greater than the width of the fork, the fork does not need to be positioned at a single specified location along the support member, as taught in the prior art, in order to be locked in the transport position 28.

To return the forks 24 to the load carrying position 26, the operator rotates the abutment member 76 to the first fork release position 98, and pivots the forks 24 about the support member 54 to the load carrying position 26 at which the shank portion 44 is abuttingly at rest with the carriage 20.

Thus it can be seen that the retention device 30 heretofore discussed enables the operator to place and lock the forks in the transport position with ease, reduces the potential of structural failure of the retnetion device due to the abutment members being substantially free from carrying the load of the forks and enables the operator to achieve locking of the fork at the transport position without precisely aligning the forks with the retention device.

Other aspects, objects and advantages of the invention can be obtained from a study of the drawings, disclosure and appended claims.

I claim:

1. A retention device (30) for a load engaging member (24), said load engaging member (24) having a load carrying position (26) and a transport position (28) and being pivotally movable therebetween; comprising:

a flange (40) positioned at a location adjacent the load engaging member (24);

a stop (66) connected to the load engaging member (24) and engageable with the flange (40) at the transport position (28) of said load engaging member (24), said stop (66) and flange (40) supporting the load engaging member (24) at the transport position (28) and preventing pivotal movement thereof in a direction past said transport position (28) and away from load carrying position (26); and means (74) for engaging said stop (66) and preventing pivotal movement of said load engaging member (24) from said transport position (24) to said load carrying position (26).

2. The retention device (30) as set forth in claim 1 including:

a carriage assembly (20), said load engaging member (24) being pivotally mounted on said carriage assembly (20) and said flange (40) being mounted on said carriage assembly (20).

3. The retention device (30) as set fourth in claim 2 wherein said means for engaging (74) includes;

an abutment member (76) rotatably connected to the carriage assembly (20) adjacent the flange (40) and movable between a first position (96) at which said stop (66) is free from contactable engagement with said abutment member (76) and said load engaging member (24) is free to pivotally move between said transport and load carrying positions (26,28) and a second position (98) at which said stop (66) is contactably engageable with said abutment member (76) and said load engaging member (24) is restrained from pivotal movement between said transport position (28) and said load carrying position (26).

4. The retention device (30) as set forth in claim 3 wherein said abutment member (76) includes;

a shaft (78) having first and second cylindrical end portions (80,82) and a middle portion (84);

a projection (86) connected to said middle portion (84) and extending radially therefrom and radially relative to said first and second end portions (80,82); and a first support (88) rotatably connecting the first cylindrical end portion (80) to one of the flange (40) and carriage assembly (20) and a second support (92) rotatably connecting the second cylindrical end portion (82) to one of the flange (40) and carriage assembly (20).

5. The retention device (30) as set forth in claim 1 wherein said load engaging member (24) has a neutral position (29) located between the load carrying position (26) and the transport position (28), said load engaging member (24) being urged under its own weight toward the load carrying position (26) in response to being between the neutral and load carrying position (29,26) and being urged under its own weight toward the transport position (28) in response to being between the neutral and transport positions (29,28).

6. The retention device (30) as set forth in claim 2 wherein said carriage assembly (20) includes;

a frame (31) having a pair of spaced apart side members (32);

a support member (54) having a cylindrical outer surface (56) and being connected to said pair of side members (32);

said load engaging member (24) having a connecting end portion (48) and an aperture (52) disposed in the connecting end portion (48), said support member (54) being disposed in said aperture (52) and said load engaging member (24) being pivotal about said support member (54) between said transport and load carrying positions (28,26);

said flange (40) having a contact surface (72), said contact surface (72) being oriented substantially parallel to said support member (54).

7. The retention device (30) as set forth in claim 6 wherein said stop (66) is connected to the connecting end portion (48) of said load engaging member (24) and extends radially therefrom relative to the support member (54), said stop (66) having a load supporting surface (70), said load supporting surface (70) being engaged with said flange contact surface (72) at the transport position (28) of said load engaging member (24).

8. The retention device (30) as set forth in claim 6 wherein said flange (40) is an elongate angle shaped member extending between and connected to the pair of spaced apart side members (32), said flange (40) being located elevationally below said support member (54).

9. The retention device (30) as set forth in claim 3 wherein said load engaging member (24) is free to pivot a preselected distance ("D") from said transport position (28) toward said load carrying position (26) prior to contactable engagement between said stop (66) and said abutment member (76), at the second position (98) of said abutment member (76).

10. The retention device (30) as set forth in claim 6 wherein said load engaging member (24) is movable along said support member (54) between said pair of side members (32), said stop (66) being contactable with said engaging means (74) in response to said load engaging member (24) being at a preselected range of locations along said support member (54).

11. In a carriage assembly (20) having a fork (24), a support member (54), a flange (40) and a frame (31), said fork (24) having a connecting end portion (48) and being pivotally connected at the connecting end portion (48) to the support member (54), said flange (40) and support member (54) being connected to the frame (31), said fork (24) being pivotally movable about the support member (54) between load carrying and transport positions (26,28) and past a neutral position (29) located therebetween, said fork (24) being urged under its own weight toward the load carrying position (26) in response to being located between the neutral position (29) and the load carrying position (26) and toward the transport position (28) in response to being located between the neutral position (29) and the transport position (28); the improvement comprising:

a stop (66) connected to the connecting end portion (48) of said fork (24) and engageable with said flange (40) at the transport position (28) of the fork (24);

means for engaging (74) said stop (66) in response to pivotal movement of said fork (24) from said transport position (28) toward said neutral position (29) and preventing said fork (24) from passing said neutral position (29).

12. The carriage assembly (20) as set forth in claim 11 wherein said means for engaging (74) said stop (66) includes;

a shaft (78) having first and second end portions (80,82) and a middle portion (84);

a projection (86) connected to said middle portion (84) and extending radially therefrom and radially relative to the first and second end portions (80,82);

first and second supports (88,92) rotatably connecting the first and second end portions (80,82) respectively, to the carriage (20), said shaft (78) being rotatable relative to said first and second supports (88,92) between a first position (96) at which said projection (86) is free from contactable engagement with said stop (66) and said fork (24) is free to pivot between the load carrying and transport positions (26,28) and a second position (98) at which said projection (86) is contactably engageable with said stop (66) and said fork (24) is restrained from pivotal movement between said transport position (28) and said load carrying position (26).

13. The carriage assembly (20) as set forth in claim 11 wherein said support member (54) is an elongate member and said fork (24) is slidably movable therealong, said stop (66) being aligned to contact said means for engaging (72) when said fork (24) is located within a preselected range of locations along said support member (54).

14. The carriage assembly (20) as set forth in claim 11 wherein said means for engaging (72) is spaced from contact with said stop (66) at the transport position (28) of said fork (24) and engageable with said stop in response to a preselected amount ("D") of pivotal movement of said fork (24) from said transport position (28) toward said load carrying position (26).

15. In a lift mast (12) having a carriage assembly (20) mounted thereon and elevationally movable relative thereto, said carriage assembly (20) having a frame (31), a support member (54), a flange (40) and a fork (24), said support member (54) and said flange (40) being connected to said frame (31), said fork (24) having a connecting end portion (48) and being pivotally connected at said connecting end portion (48) to said support member (54), said fork (24) being pivotally movable about said support member (54) between a load carrying position (26) and a transport position (28); the improvement comprising:

a stop (66) connected to the connecting end portion (48) and engageable with the flange (40) at the transport position (28) of said fork (24) to support the fork (24) at the transport position (28); and means for engaging (74) said stop (66) in response to a preselected amount of pivotal movement of said fork (24) from said transport position (28) toward said load carrying position (26) and preventing further pivotal movement of said fork (24) toward said load carrying position (26).

16. The lift mast (12) as set forth in claim 15 wherein said means for engaging (74) includes;

an abutment member (76) connected to said carriage (20) and movable between a first position (96), at which said stop (66) is spaced from contacting said abutment members (76) and said fork (24) is free to pivotally move between said load carrying and transport positions (26,28), and a second position (98), at which said abutment member (76) is engageable with said stop (66) and said fork (24) is restrained from pivotal movement between the transport position (28) and the load carrying position (26).

* * * * *